United States Patent [19]

Long et al.

[11] 4,250,014

[45] Feb. 10, 1981

[54] COAL LIQUEFACTION PROCESS

[75] Inventors: Robert B. Long, Atlantic Highlands; Martin L. Gorbaty, Westfield, both of N.J.; Lonnie W. Vernon, Baytown, Tex.

[73] Assignee: Exxon Research & Engineering Co., Florham Park, N.J.

[21] Appl. No.: 935,568

[22] Filed: Aug. 21, 1978

[51] Int. Cl.[3] ..... C10G 1/00; C10G 1/06; C10B 57/08; C10B 53/00

[52] U.S. Cl. ..... 208/8 LE; 208/8 R; 208/10; 201/9; 201/23

[58] Field of Search ..... 208/8 LE, 8 R, 10; 201/9, 23

[56] References Cited

U.S. PATENT DOCUMENTS

| | | | |
|---|---|---|---|
| 2,166,321 | 7/1939 | Pott | 208/8 LE |
| 3,692,662 | 9/1972 | Wilson et al. | 208/8 LE |
| 3,791,957 | 2/1974 | Wolk | 208/10 |
| 3,970,541 | 7/1976 | Williams et al. | 208/8 LE |
| 3,997,424 | 12/1976 | Urquhart | 208/8 R |
| 4,019,975 | 4/1977 | Urquhart | 208/10 |
| 4,036,730 | 7/1977 | Brink et al. | 208/8 LE |
| 4,036,731 | 7/1977 | Martin | 208/8 LE |
| 4,075,079 | 2/1978 | Lang | 208/8 LE |
| 4,082,643 | 4/1978 | Gatais et al. | 208/8 LE |

*Primary Examiner*—Delbert E. Gantz
*Assistant Examiner*—William G. Wright
*Attorney, Agent, or Firm*—Marthe L. Gibbons

[57] ABSTRACT

Particulate coal is contacted with a vapor phase hydrogen donor solvent to swell the coal particles and, thereafter, the swollen coal particles are subjected to coal liquefaction conditions in the presence of a liquid phase solvent.

11 Claims, 1 Drawing Figure

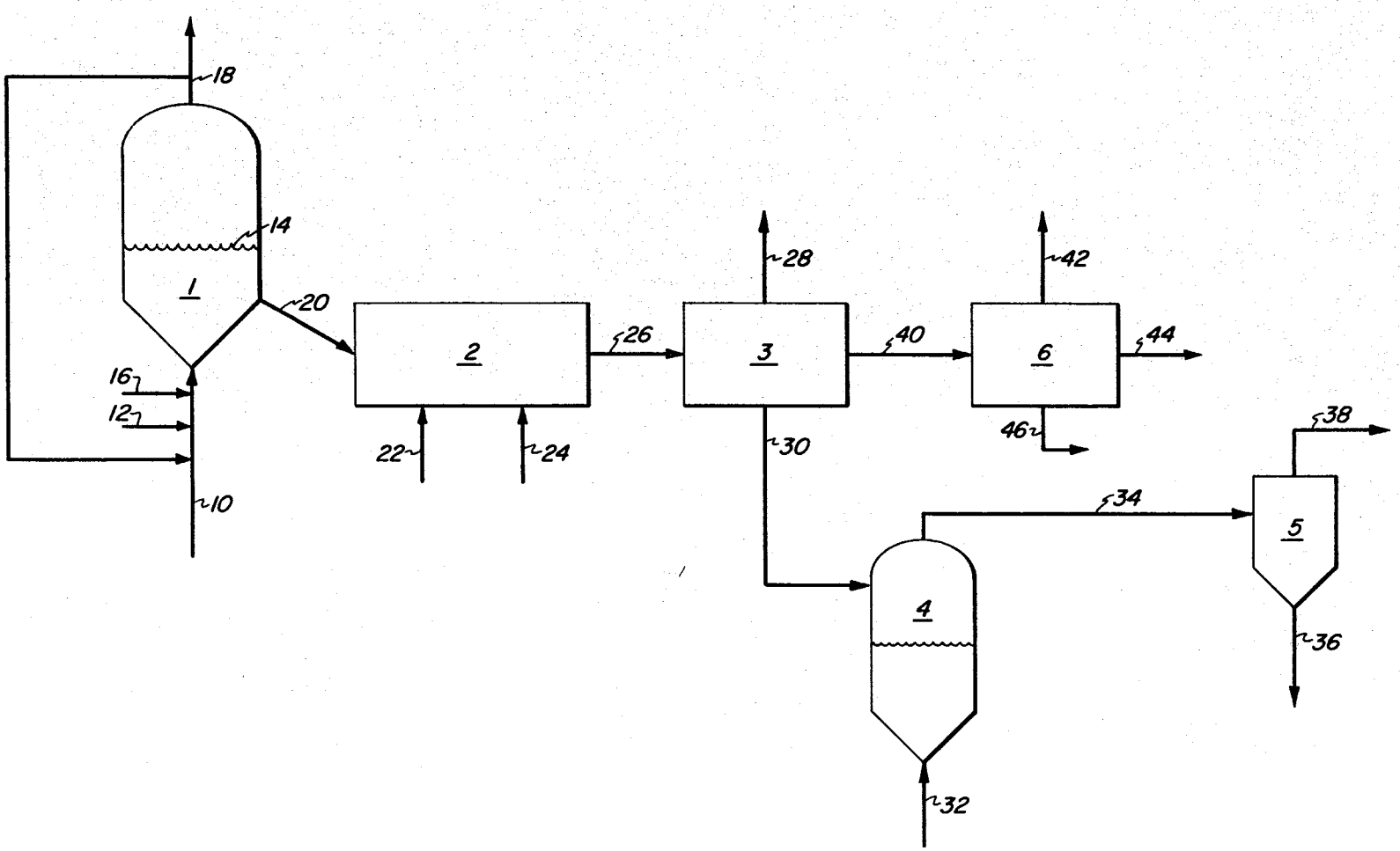
1
2
3
4
5
6
10
12
14
16
18
20
22
24
26
28
30
32
34
36
38
40
42
44
46

COAL LIQUEFACTION PROCESS

BACKGROUND OF THE INVENTION

1. Field of the Invention

The present invention relates to an improved coal liquefaction process. More particularly, the invention relates to a process comprising pretreatment of solid coal particles with a vapor phase hydrogen donor solvent followed by coal liquefaction in the presence of a liquid phase solvent.

2. Description of the Prior Art

Coal liquefaction processes in which coal with or without a diluent is subjected to elevated temperatures and pressures to convert the coal to normally liquid hydrocarbonaceous products are well known. Coal liquefaction processes in which coal is converted in the presence of a hydrogen donor diluent with or without added molecular hydrogen are also known. See, for example, U.S. Pat. No. 3,645,885; U.S. Pat. No. 3,617,513 and U.S. Pat. No. 3,841,991, the teachings of which are hereby incorporated by reference.

It is also known to liquify coal in the presence of a vapor phase solvent or in the presence of a vapor phase solvent which comprises a hydrogen donor, see, for example, U.S. Pat. No. 3,997,424 and U.S. Pat. No. 4,036,731.

U.S. Pat. No. 3,970,541 discloses a process for the extraction of coal. The coal and solvent are heated to 370° C. at a rate of 20° C. per minute and, thereafter, to 400° to 500° C. at a rate of less than 10° C. per minute. The solvent is preferably in the gas phase over the greater part of the range in which the slower rate of heating is performed.

U.S. Pat. No. 3,692,662 discloses a staged coal liquefaction process in which a slurry of coal in a solvent, such as a hydrogen donor solvent, is maintained at a temperature below 700°+ to effect formation of a dispersion and, thereafter, the dispersed slurry is heated to a temperature above 700° F.

U.S. Pat. No. 3,791,957 discloses a coal pretreatment at a pressure in excess of 1000 psig in the presence of added hydrogen at a temperature from 600° to 750° F. followed by catalytic ebullating bed coal hydrogenation.

It is also known to produce liquid hydrocarbons by a fluid coking process in which coal particles are slurried in a hydrogen donor solvent (see U.S. Pat. No. 3,841,991). Fluid coking of coal in a water slurry is also known (see U.S. Pat. No. 3,272,720).

It has now been found that pretreatment of solid coal particles with a vapor phase hydrogen donor solvent gives improved coal liquefaction results, such as an increase yield of coal liquids.

SUMMARY OF THE INVENTION

In accordance with the invention, there is provided, in a coal liquefaction process wherein particulate coal is converted to a hydrocarbonaceous oil in the presence of a liquid phase solvent, in a coal liquefaction zone, at coal liquefaction conditions, the improvement which comprises: (a) contacting said particulate coal with a vapor phase hydrogen donor solvent at a temperature ranging from about 150° to about 350° C. and at a pressure ranging from about 0 to about 150 psig for a time sufficient for said coal to sorb at least a portion of said vapor phase solvent and thereby swell and increase in weight by at least 3 weight percent, and (b) subsequently subjecting the resulting swollen coal to said coal liquefaction conditions.

The term "coal" is used herein to designate a normally solid carbonaceous material including all ranks of coal, such as anthracite coal, bituminous coal, semibituminous coal, sub-bituminous coal, lignite, peat and mixtures thereof.

BRIEF DESCRIPTION OF THE DRAWING

The FIGURE is a schematic flow plan of one embodiment of the invention.

DETAILED DESCRIPTION OF THE INVENTION

Particulate coal is contacted with a vapor phase hydrogen donor solvent at a temperature below coal liquefaction temperature, generally at a temperature ranging from about 150° to about 350° C., preferably at a temperature ranging from about 204° to about 350° C., more preferably at a temperature ranging from about 204° to about 310° C., most preferably at a temperature ranging from about 204° to about 250° C., and at a pressure ranging from about 0 to about 150 psig for a time sufficient for the coal to sorb at least a portion of the solvent and become swollen, that is, the weight of the coal will be increased at least about 3 weight percent. Generally, the coal particles will be treated for a time sufficient to increase the weight of the coal from about 3 to about 50 weight percent, preferably from about 5 to about 50 weight percent relative to the initial untreated coal. The initial particle size of the coal prior to treatment with the vapor phase solvent will generally range from about 0.01 to about 0.25 inches in diameter, preferably from about 0.05 to about 0.13 inches in diameter. Suitable contacting time will generally range from about 10 to about 100 minutes. The vapor phase hydrogen donor solvents useful in the practice of the present invention, defined in terms of hydrogen donor potential are hydrogen donor solvents which contain at least 0.8 weight percent, preferably 1.2 to 3 weight percent donatable hydrogen based on the weight of the solvent. The hydrogen donor solvent may be any of the known hydrogen donor solvents. The hydrogen donor solvent will typically be an intermediate stream boiling, at atmospheric pressure, between 350° F. and about 800° F., preferably between 400° F. and about 700° F., derived from a coal liquefaction reaction. This stream contains hydrogenated aromatics, naphthenic hydrocarbons, phenolic materials, partially hydrogenated quinolines and similar compounds that will normally contain at least 30 weight percent, preferably at least 50 weight percent of compounds which are known to be hydrogen donor under the temperature and pressure conditions employed in the coal liquefaction zone. Other hydrogen-rich solvents may be used instead or in addition to such coal derived liquids, particularly on initial start up of the process. Suitable hydrogen donor compounds added to or originally present in the hydrogen donor solvent include indane, $C_{10}$ to $C_{12}$ tetralins, decalins, hydrogenated methylnaphthalene, hydrogenated dimethylnaphthalene, hydrogenated $C_{12}$ and $C_{13}$ acenaphthenes, partially hydrogenated quinolines and similar donor compounds. The hydrogen donor solvent selected will be one that can be in vapor phase at the desired coal pretreatment conditions. Suitable solvent to coal weight ratio for use in the pretreatment stage include a weight ratio ranging from about 0.05 part solvent:1 part coal to 1 part solvent:1 part coal.

After the coal particles and vapor phase hydrogen donor solvent have been in contact for a time sufficient to swell the coal particles to a desired extent, the swollen coal particles are subjected to coal liquefaction conditions. If desired, in some embodiments of the invention, the entire effluent of the coal pretreatment stage can be passed to a coal liquefaction zone.

COAL LIQUEFACTION STAGE

The coal liquefaction zone can be operated at any of the conventional coal liquefaction conditions, conducted in the presence of a liquid phase solvent, known to be suitable to convert coal to coal liquids. The liquid phase solvent may have the same chemical composition as the solvent used for the vapor phase pretreatment or it can be a different solvent. Typically, the liquid phase solvent will be a hydrogen donor solvent. If desired, a gas containing molecular hydrogen may be introduced into the coal liquefaction zone directly or indirectly, that is, by adding a molecular hydrogen-containing gas to the coal pretreatment zone and subsequently introducing the entire pretreatment zone effluent comprising the molecuar hydrogen-containing gas into the coal liquefaction zone.

Suitable coal liquefaction conditions include a temperature ranging from about 371° C. to about 816° C., preferably a temperature ranging from about 426° C. to about 816° C., and a pressure ranging from about 0 to about 3,000 psig, preferably from about 300 to 3,000 psig, more preferably from about 10 to about 150 psig. Suitable reaction time in a coal liquefaction zone include from less than 1 minute to about 2 hours, preferably from about 10 to about 100 minutes.

The coal liquefaction reaction is conducted for a time sufficient to convert coal to the desired amount of hydrocarbonaceous normally liquid oil product. By "normally liquid" is intended herein that the product is liquid at atmospheric pressure and ambient temperature.

When the coal liquefaction reaction is conducted in the presence of an added molecular hydrogen, suitable hydrogen partial pressure may range from about 10 psig to about 3000 psig, preferably from about 1,000 to about 3,000 psig. The effluent of the coal liquefaction zone comprises a solid residue (char plus unconverted coal plus ash) and a vapor phase product, which includes gases and a normally liquid hydrocarbonaceous oil product. The effluent may be passed through a separation zone. The solids may be separated by conventional means from the vapor phase product.

DESCRIPTION OF THE PREFERRED EMBODIMENT

The preferred embodiment will be described with reference to the accompanying FIGURE.

Referring to the FIGURE, a vaporized hydrogen donor solvent, for example, tetrahydroquinoline, is introduced by line 10 into vessel 1 which contains a fluidized bed of coal having an upper level indicated at 14. The coal particles in the bed will generally be particles ranging from about 40 to about 1,000 microns in size. Additional coal particles are introduced into solvent line 10 via line 12. The vaporized solvent is introduced into vessel 1 at a velocity sufficient to maintain the coal particles in a fluidized state, for example, a superficial fluidizing velocity in the range from about 0.5 to 5 feet per second. In vessel 1, the pretreatment stage of the present invention is carried out. The fluidized bed coal pretreatment zone is maintained at a temperature ranging from about 150° C. to about 350° C. and at a pressure ranging from about 0 to about 150 psig. The coal particles are maintained in fluidized state by the flow of vapor phase hydrogen donor solvent through the bed of coal. If desired, a molecular hydrogen-containing gas may also be introduced into vessel 1 by injecting the gas into line 10 via line 16. The hydrogen-containing gas may be substantially pure hydrogen or a gaseous mixture containing other gases, such as off gases from reforming processes, etc. The coal and vapor phase hydrogen donor solvent are contacted in vessel 1 for a period of time sufficient for the coal particles to sorb a portion of the vaporous hydrogen donor solvent and become swollen coal particles. The coal is sufficiently swollen when it has increased in weight by about 3 to about 50 percent relative to the initial weight of the coal. Suitable residence time in vessel 1 includes from about 10 minutes to about 100 minutes. A portion of the vapors of vessel 1 is removed overhead via line 18. The overhead comprises the solvent. If desired, the solvent may be fractionated by conventional means and at least a portion thereof may be recycled to vessel 1. Furthermore, the solvent may be hydrogenated in a conventional way to improve its hydrogen donor properties. A stream of swollen coal particles is removed via line 20 and introduced into a coal liquefaction reactor 2. A molecular hydrogen-containing gas is introduced into coal liquefaction reactor 2 by line 22 and a liquid phase hydrogen donor solvent, such as, for example, an intermediate hydrocarbonaceous stream recovered from the process is introduced into coal liquefaction reactor 2 by line 24. The coal liquefaction zone in reactor 2 is maintained at a temperature ranging from about 426° C. to about 482° C. and at a pressure ranging from about 800 to about 3000 psig. Molecular hydrogen is added to the liquefaction zone at a rate of about 1000 to 6000 SCF/bbl. Residence time in the coal liquefaction zone ranges from about 5 to about 130 minutes. The effluent of the coal liquefaction zone comprises an oil product, gases and a solid residue. The effluent is passed by line 26 to a separation zone 3 from which gases are removed overhead by line 28. The solids may be removed from the oil product by conventional means, such as settling. The solids are removed from separation zone 3 by line 30 and passed to a gasification vessel 4. Vessel 4 is operated as a fluidized bed gasification zone in which the solid residue, including char, is fluidized by gases introduced into vessel 4. The gasification zone is maintained at a temperature ranging from about 760° C. to about 1093° C., preferably at a temperature ranging from about 926° C. to about 1037° C., and at a pressure ranging from about 10 to about 150 psig. A molecular oxygen-containing gas, such as air, commercial oxygen or air enriched with oxygen is introduced into gasification vessel 4 by line 32. The mixture of steam and oxygen-containing gas fluidizes the solid residue and reacts with the char to produce a hydrogen-containing gas. The effluent of the gasification zone is passed via line 34 to a separation zone 5 where the remaining solid residue (char and ash) is removed via line 36. The hydrogen-containing gas is recovered via line 38. The hydrogen-containing gas may be used as such or scrubbed in a conventional way. If desired, at least a portion of this hydrogen-containing gas may be recycled to coal liquefaction reactor 2. The oil product is removed from separation zone 3 by line 40 and passed to a fractionation zone 6 wherein a light fraction is removed by line 42, an intermediate fraction is recovered by line 44 and a heavy fraction is recovered by line 46. If desired, the intermediate fraction may be hydrogenated and used as the hydrogen donor solvent in the process.

The following example is presented to illustrate the invention.

EXAMPLE

A small vertical continuous flow reactor was built which would hold about 15 g. of coal. At the bottom, a boiler was installed to completely vaporize solvent pumped to it so that the solvent vapors passed up through the granular fixed bed of 10–20 mesh coal. The coal was held at a temperature and pressure such that none of the solvent vapors would condense as liquid on the coal. To start a run, the coal was charged to the reactor, the boiler and coal were heated to above the boiling point of the solvent, the solvent was started to the boiler and hydrogen flow was started also to the boiler.

After passing solvent vapors up through the bed of coal for about one hour, the solvent flow was stopped and the coal bed was cooled under flowing hydrogen.

| Solvent | Tetralin | Quinoline | Tetrahydro Quinoline |
|---|---|---|---|
| Coal Charge, g. | 14.89 | 14.89 | 14.89 |
| Vapor Treating, Time, Min. | 65 | 70 | 60 |
| Vapor Treating, Temp., °C. | 260 | 272 | 268 |
| Vapor Treating, Pressure | | ATMOSPHERIC | |
| Recovered Coal, g. | 14.56 | 15.29 | 15.52 |

Three different solvents were used, tetralin and tetrahydroquinoline being hydrogen donors and quinoline not being a hydrogen donor. The coal recovered after the solvent vapor treat was then liquefied in tubing bombs in a sand bath using 3 grams of treated coal and 6 grams of tetralin in each bomb. The liquefactions were run at 425° C. and a maximum 1500 psig hydrogen pressure for a period of 60 minutes. The product was Soxhet extracted with cyclohexane and vacuum dried and the amount of DAF conversion was determined from the ash content of the dried residue.

| Solvent Used in Vapor Pre-treat | None | Tetralin | Quinoline | Tetra-hydroline Quinoline |
|---|---|---|---|---|
| Solvent Used in Liquefaction | | Tetralin | | |
| DAF Conversion | 53 | 52 | 53 | 65 |

The data on conversion are good to about ±1% indicating that pretreating with tetralin and quinoline in this set of experiments had essentially no effect on the subsequent liquefaction in tetralin. However, pretreating with tetrahydroquinoline vapors showed a marked increase in liquefaction conversion.

During the tetralin vapor treat, the coal lost 2.2 wt. % which was primarily water. However, quinoline gained 2.7 wt. % and tetrahydroquinoline gained 4.2 wt. %. Independent experiments have shown that the coal loses 1.8 wt. % when held for 60 minutes at 260° C. and 2.2 wt. % when held for 60 minutes at 270° C. This means that the coal sent to the high pressure liquefaction contained essentially no sorbed solvent in the case of tetralin, about 5% solvent in the case of quinoline and 6.4% solvent in the case of tetrahydroquinoline. Since tetralin will normally sorb into this coal to the extent of 7 wt. % under the vapor treating conditions used, it must have been lost from the coal during the cooling period under flowing hydrogen. Therefore, the tetralin run was not in accordance with the present invention since the pretreated coal subjected to coal liquefaction had not been increased in weight through sorption by at least 3 weight percent relative to the untreated coal. Thus, the tetralin results came out as would be expected confirming the value of the donor solvent being present in advance of the liquefaction heat-up step.

What is claimed is:

1. In a coal liquefaction process wherein the particulate coal is converted to a hydrocarbonaceous oil in the presence of a liquid phase solvent, in a coal liquefaction zone, at coal liquefaction conditions, the improvement which comprises:

(a) contacting said particulate coal with a vapor phase hydrogen donor solvent at a temperature ranging from about 150° to about 350° C. and at a pressure ranging from about 0 to about 150 psig, for a time sufficient for said coal to sorb at least a portion of said vapor phase solvent and thereby swell, and increase in weight by at least about 3 weight percent, and (b) subsequently subjecting the resulting swollen coal to said coal liquefaction conditions.

2. The process of claim 1 wherein said coal is increased in weight from about 3 to about 50 weight percent, based on the initial weight of said coal.

3. The process of claim 1 wherein said temperature of step (a) ranges from about 204 to about 350° C.

4. The process of claim 1 wherein said particulate coal is contacted with said vapor phase solvent for a period of time ranging from about 10 to about 100 minutes.

5. The process of claim 1 wherein the solvent to coal weight ratio ranges from about 0.05:1 to 1:1 in said contacting step.

6. The process of claim 1 wherein said coal liquefaction is conducted in the presence of added molecular hydrogen.

7. The process of claim 1 wherein said coal liquefaction conditions include a temperature ranging from about 371° to about 816° C.

8. The process of claim 1 wherein said coal liquefaction conditions include a pressure ranging from about 0 to about 3000 psig.

9. The process of claim 1 wherein said particulate coal in step (a) is maintained in a fluidized bed fluidized by a fluidizing agent comprising said vapor phase solvent.

10. In the process of claim 1, the improvement which comprises the additional steps of separating the effluent of said coal liquefaction zone into a vapor phase product and a solid residue, and contacting said solid residue with steam and an oxygen-containing gas to produce a hydrogen-containing gas.

11. The process of claim 1 wherein said temperature of step (a) ranges from about 204° to about 250° C.

* * * * *